US006875044B1

(12) United States Patent
Lee

(10) Patent No.: US 6,875,044 B1
(45) Date of Patent: Apr. 5, 2005

(54) SAFETY SERIAL ATA IDC POWER CABLE PLUG CONNECTOR

(75) Inventor: George Lee, Irvine, CA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/737,439

(22) Filed: Dec. 15, 2003

(51) Int. Cl.[7] ..... H01R 4/24
(52) U.S. Cl. ..... 439/404; 439/660
(58) Field of Search ..... 439/404, 405, 439/660

(56) References Cited

U.S. PATENT DOCUMENTS 6,210,204 B1 * 4/2001 Ko et al. ..... 439/404
6,319,068 B1 * 11/2001 Bao ..... 439/660
6,402,552 B1 6/2002 Wagner
6,416,349 B1 * 7/2002 Lee ..... 439/404
6,447,340 B1 * 9/2002 Wu ..... 439/660
6,616,477 B1 9/2003 Chang
6,623,299 B1 * 9/2003 Liu ..... 439/604
6,666,706 B1 * 12/2003 Jones et al. ..... 439/405
6,739,897 B1 * 5/2004 Chang ..... 439/404
6,743,060 B2 * 6/2004 Wu ..... 439/741
6,761,576 B1 * 7/2004 Ye et al. ..... 439/404
2003/0003793 A1 1/2003 Chang
2003/0060087 A1 3/2003 Yi-Tse

* cited by examiner

*Primary Examiner*—Gary Paumen
(74) *Attorney, Agent, or Firm*—Wei Te Chung

(57) ABSTRACT

A safety Serial ATA IDC power cable plug connector (1) includes an insulative housing (2), a number of IDC power contacts (3) retained in the housing, a number of wires (4) connected to the power contacts, and a cover (5) mounted onto the insulative housing with the wires securely retained therebetween. The insulative housing comprises an engaging portion (20) providing a number of protrusions (26) and an opposite terminating portion (21). The engaging portion has an upper wall (202), a lower wall (204) and a pair of lateral walls (206) cooperatively defining a receiving space (22) therebetween for receiving a complementary Serial ATA power receptacle connector (6). An L-shaped tongue (24) extends into the receiving space. The cover comprises a number of latching arms (57) latching onto corresponding protrusions of the housing.

2 Claims, 9 Drawing Sheets

SAFETY SERIAL ATA IDC POWER CABLE PLUG CONNECTOR

CROSS-REFERENCE TO RELATED APPLICATIONS

This application is related to co-pending U.S. patent application Ser. No. 10/394,800, filed Mar. 21, 2003 and entitled "CABLE CONNECTOR ASSEMLBY WITH IDC CONTACTS", and co-pending U.S. patent application Ser. No. 10/397,446, filed Mar. 25, 2003 and entitled "CABLE CONNECTOR ASSEMLBY WITH LATCHING MEANS", both of which have the same applicant and assignee as the present invention.

BACKGROUND OF THE INVENTION

1. Field of the Invention

The present invention generally relates to a cable connector, and more particularly to a safety Serial ATA (Advanced Technology Attachment) cable plug connector.

2. Description of Related Art

It is expected that Serial ATA, which is featured in lower voltage and lower pin count, will eventually completely replace today's parallel ATA. According to the Serial ATA standard, a Serial ATA device, generally disk drives and storage peripherals, may be connected to a host through a cable. For connection via cable, a device plug connector mates with a cable receptacle connector at one end of the cable. A second cable receptacle connector at the other end of the cable is adapted for mating with a host plug connector, so that an electrical connection is established between the Serial ATA device and the host. The Serial ATA standard does not specify a cable plug connector. However, in some situations, a Serial ATA cable plug connector may be desired. Therefore, there exists a need to develop a Serial ATA cable plug connector.

According to the Serial ATA standard, a standard Serial ATA power plug connector comprises an exposed L-shaped tongue with power contacts disposed thereon for being inserted into a corresponding L-shaped receiving slot of a standard Serial ATA cable receptacle connector. When applying a Serial ATA power cable plug connector, there is some danger that the hand of the user which holds the cable plug connector while pulling may accidentally touch a power contact while the latter is still in contact with a live complementary receptacle. Furthermore, the provision of the exposed L-shaped tongue may cause damage to the power contacts disposed thereon. Therefore, a safety Serial ATA power cable plug connector is desired.

Further, the Serial ATA standard does not specify the termination method for a Serial ATA cable connector. It is well known that there are several conventional methods, such as soldering, crimping, IDC (Insulation Displacement Connection) etc., for terminating a cable to contacts of an electrical connector. U.S. Pat. Nos. 6,402,552 and 6,616,477 each disclose a Serial ATA cable receptacle connector having its cable wires terminated to corresponding tail portions of contacts by soldering. However, this method is laborious and time-consuming. U.S. Pat. Publication No. 20030060087 discloses a Serial ATA cable receptacle connector having its cable wires terminated to corresponding tail portions of contacts by crimping. However, this method complicates the design and manufacturing of the contacts. In comparison with the soldering and crimping methods, the IDC method allows rapid and simple connection of conducting wires to contacts without stripping nor crimping the wires. Therefore, it is also desired to develop a Serial ATA cable connector using IDC technology.

Hence, a safety Serial ATA IDC power cable plug connector is needed to address the problems encountered in the related art.

SUMMARY OF THE INVENTION

Accordingly, one object of the present invention is to provide a safety Serial ATA IDC power cable plug connector for protecting contacts thereof and for preventing an accidental contact of the user hand with live power contacts thereof.

Another object of the present invention is to provide a safety Serial ATA IDC power cable plug connector wherein mating with a complementary standard Serial ATA receptacle connector is unencumbered by the safety features.

A further object of the present invention is to provide a safety Serial ATA IDC power cable plug connector securely attaching wires thereof to IDC contacts thereof for achieving a more reliable and simple power transmission.

In order to achieve the objects set forth, a safety Serial ATA IDC power cable plug connector in accordance with the present invention comprises an insulative housing, a plurality of IDC power contacts retained in the housing, a plurality of wires connected to the power contacts, and a cover mounted onto the insulative housing with the wires securely retained therebetween. The insulative housing comprises an engaging portion and an opposite terminating portion. The engaging portion has an upper wall, a lower wall and a pair of lateral walls cooperatively defining a receiving space therebetween for receiving a complementary Serial ATA IDC power cable receptacle connector. An L-shaped tongue extends into the receiving space. The terminating portion comprises a plurality of posts. Every two neighboring posts define a contact-receiving tunnel therebetween. Each contact comprises a mating portion disposed on one side of the L-shaped tongue of the housing, and an opposite insulation displacement portion received in a corresponding contact-receiving tunnel. Each wire is received in dual slots of the insulation displacement portion of a corresponding contact and electrically connected with the contact in the contact-receiving tunnel. The cover comprises a plurality of latching arms latching onto corresponding protrusions of the housing.

Other objects, advantages and novel features of the invention will become more apparent from the following detailed description when taken in conjunction with the accompanying drawings.

DETAILED DESCRIPTION OF THE INVENTION

Figure 1:
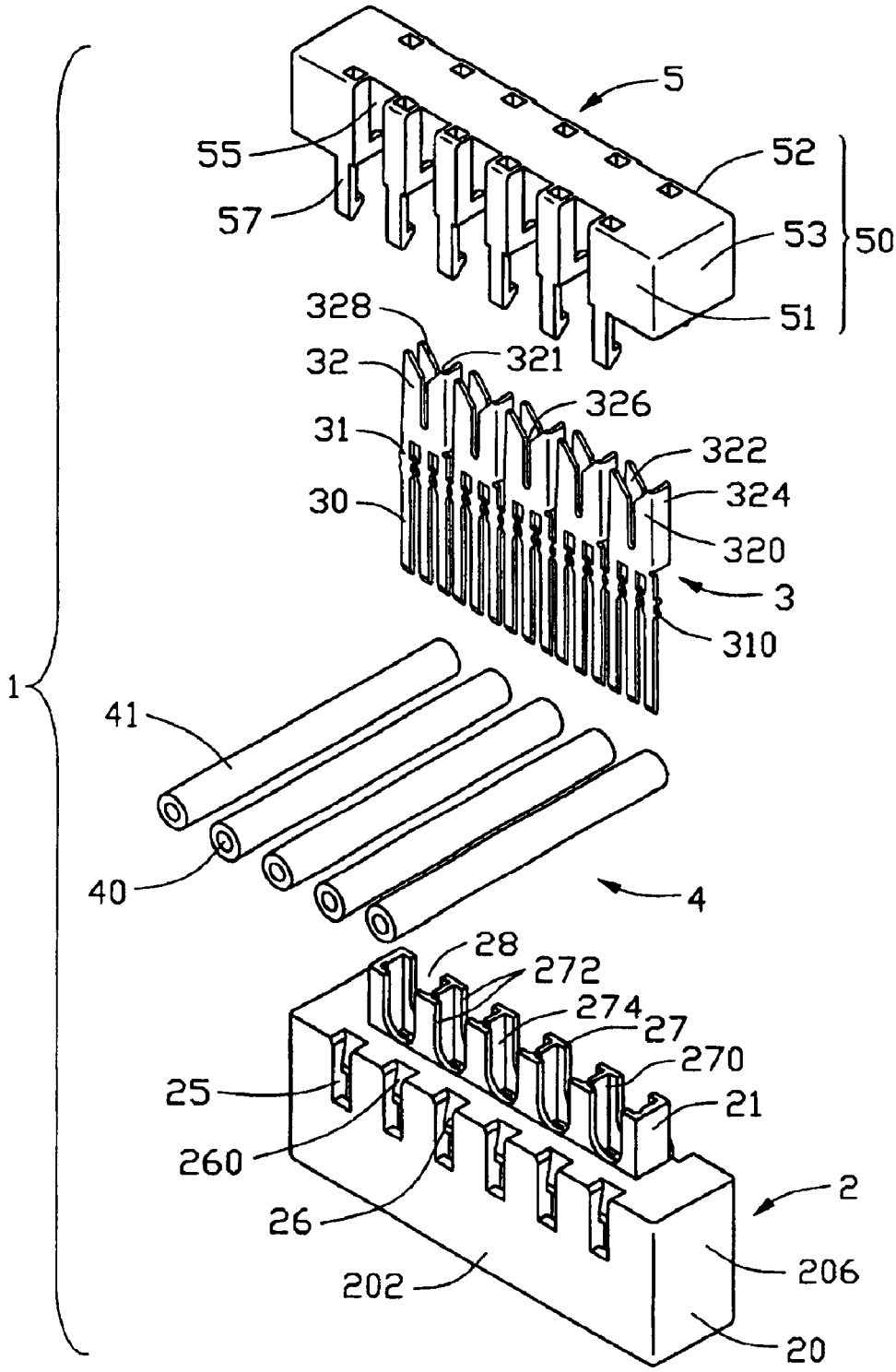
FIG. 1 is an exploded, perspective view of a safety Serial ATA IDC power cable plug connector in accordance with the present invention.
Figure 2:
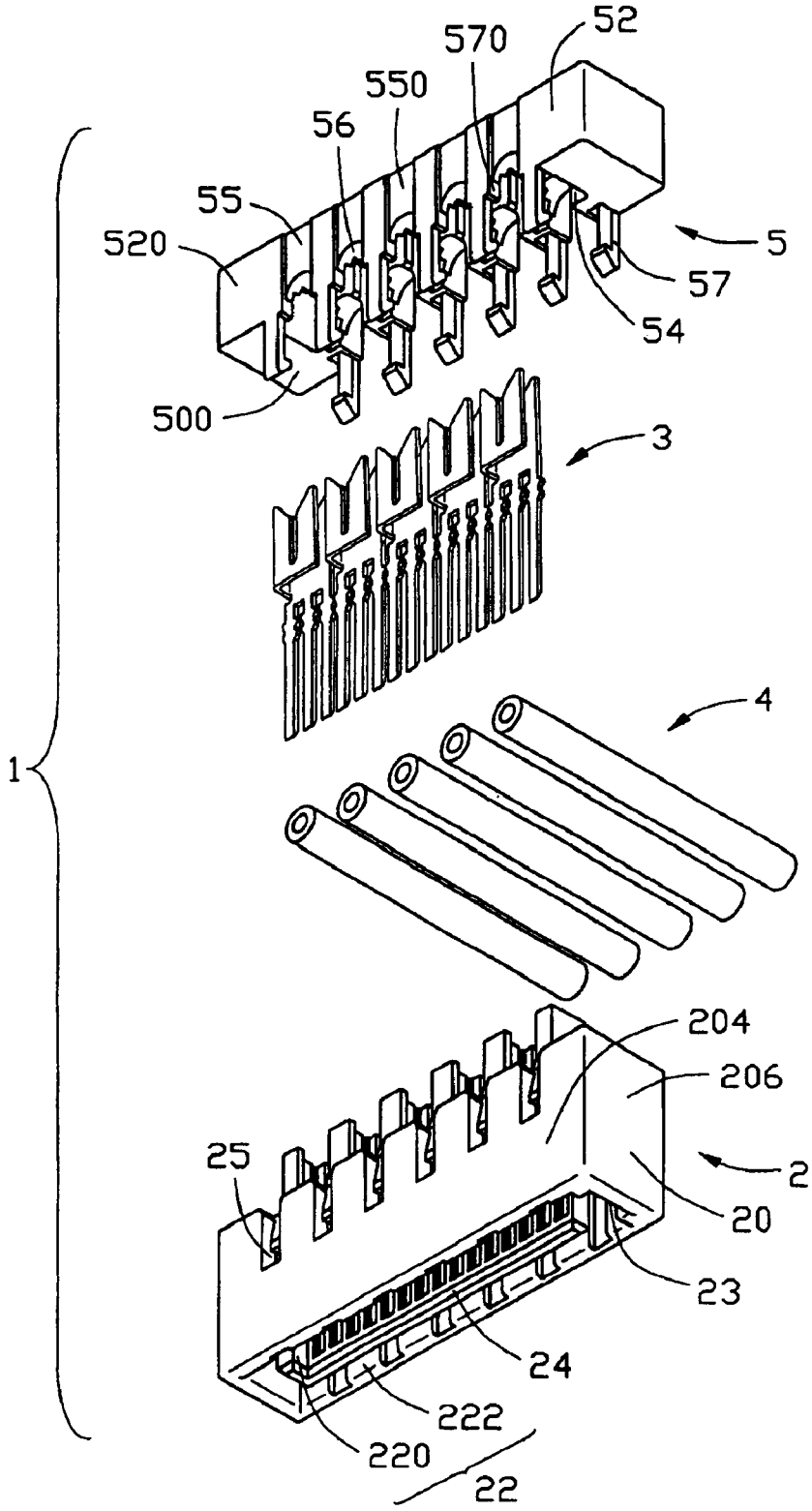
FIG. 2 is a view similar to FIG. 1, but taken from different aspects.

Referring to FIG. 1 and FIG. 2, a safety Serial ATA IDC power cable plug connector 1 in accordance with the present invention comprises an insulative housing 2, a plurality of IDC power contacts 3 to be received in the insulative housing 2, a plurality of wires 4 to be terminated with the contacts 3, and an insulative cover 5 to be assembled to the insulative housing 2.

The insulative housing 2 comprises a front engaging portion 20 and an opposite terminating portion 21. The engaging portion 20 of the insulative housing 2 defines a receiving space 22 circumscribed by an upper wall 202, a lower wall 204 and a pair of lateral walls 206, and a slot 23 defined at an end thereof in communication with the receiving space 22. An L-shaped tongue 24 projects into the receiving space 22 and divides the receiving space 22 into a large-dimensioned part 220 and a small-dimensioned part 222. A plurality of recesses 25 is defined in the upper and lower walls 202, 204. A protrusion 26 is formed at the bottom of each recess 25 and has an inclined surface 260. The rear terminating portion 21 has a plurality of rearwardly projecting posts 27 and every two neighboring posts 27 together define a U-shaped contact-receiving tunnel 28 therebetween. Each post 27 defines a pair of channels 270 respectively communicating with neighboring contact-receiving tunnels 28. A pair of opposite walls 272 and a side surface 274 of the post 27 define the channel 270.

Each contact 3 has a fork-shaped configuration and comprises a three-beam mating portion 30, a three-beam retention portion 31 extending rearwardly from the mating portion 30, and an insulation displacement portion 32 extending rearwardly from the retention portion 31 for electrically connecting with a corresponding wire 4. Each retention portion 31 has a plurality of barbs 310 on opposite sides thereof for reliably retaining the contact 3 to the insulative housing 2. The insulation displacement portion 32 comprises a first and a second walls 320, 322 and an intermediate section 324 connecting the walls 320, 322. The first wall 320 extends rearwardly from the three-beam retention portion 31. Each wall 320, 322 defines an elongated slot 326 therein. The walls 320, 322 are oppositely configured such that the slots 326 are aligned with each other, whereby the wire 4 can be inserted into the slots 326 in both walls 320, 322 and remains substantially straight. Each wall 320, 322 has a pair of opposite inwardly inclined edges 328 at a rear end thereof, thereby forming an entry 321 communicating with the slot 326.

Each wire 4 comprises a conductor 40 and an outer insulator 41.

Figure 3:
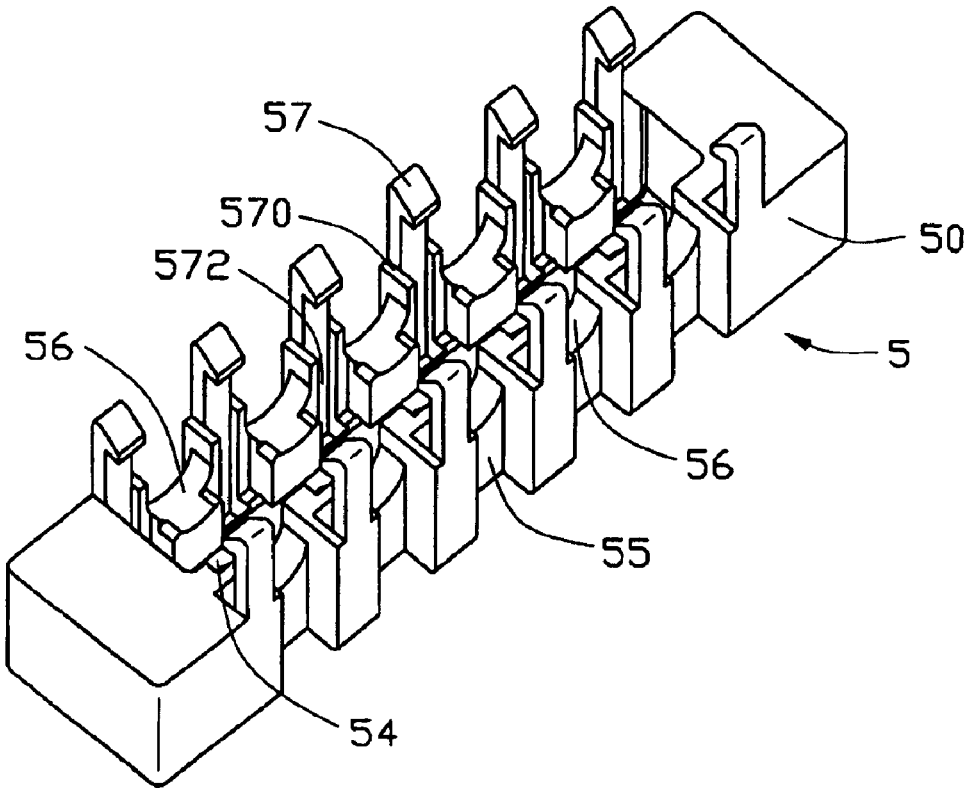
FIG. 3 is a perspective view of a cover of the safety Serial ATA IDC power cable plug connector of the present invention.

In conjunction with FIG. 3, the cover 5 comprises a body 50 and a plurality of pairs of latching arms 57 extending forwardly from the body 50 and beyond a front surface 500 of the body 50. The body 50 has opposite top and bottom walls 51, 52, and a pair of sidewalls 53. The top and the bottom walls 51, 52 are partly cutoff to form a plurality of ribs 55. A plurality of semicircular wire-receiving concaves 56 is defined in respective ribs 55. A plurality of receiving cavities 54 is defined in the body 50 respectively corresponding to the posts 27 of the housing 2. The plurality of pairs of latching arms 57 corresponds to the recesses 25 of the housing 2 and projects forwardly from the respective top and bottom walls 51, 52. Each latching arm 57 extending from the bottom wall 52 comprises a pair of vertical walls 570 extending upwardly from opposite edges thereof, whereby a cavity 572 communicating with a corresponding receiving cavity 54 is circumscribed by the vertical walls 570 and an inner side of the latching arm 57.

Figure 4:
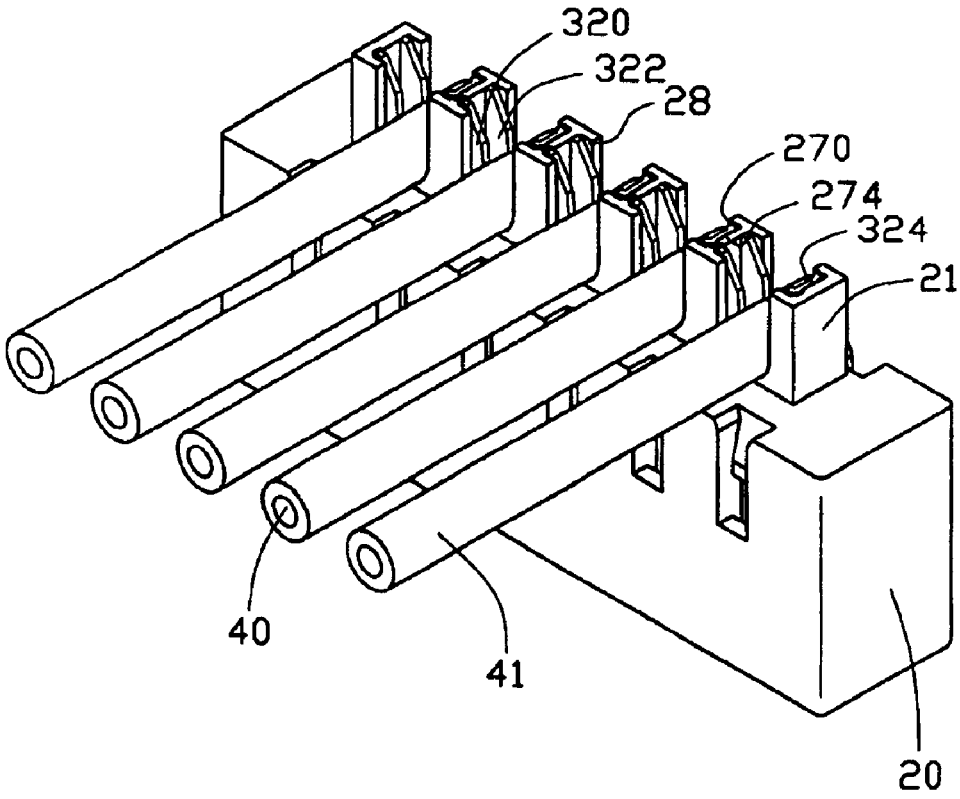
FIG. 4 is a perspective view showing wires terminated to contacts received in an insulative housing of the safety Serial ATA IDC power cable plug connector of the present invention.
Figure 5:
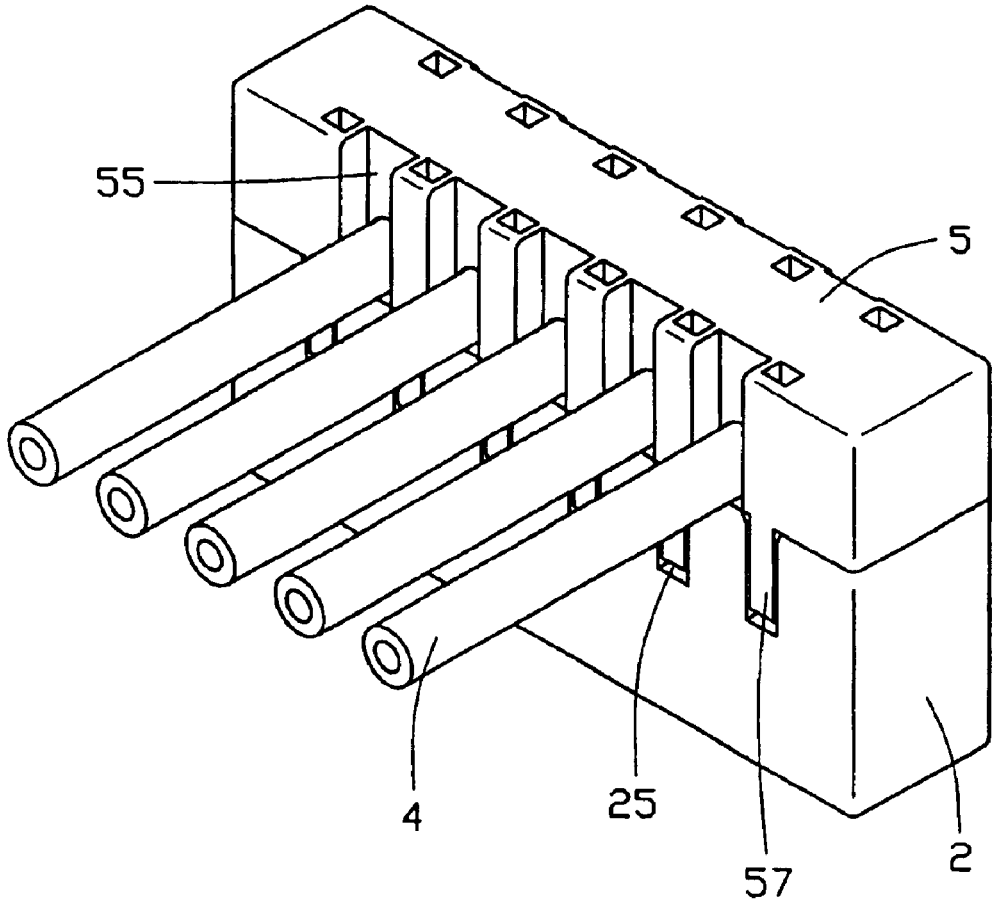
FIG. 5 is an assembled view of FIG. 1.
Figure 6:
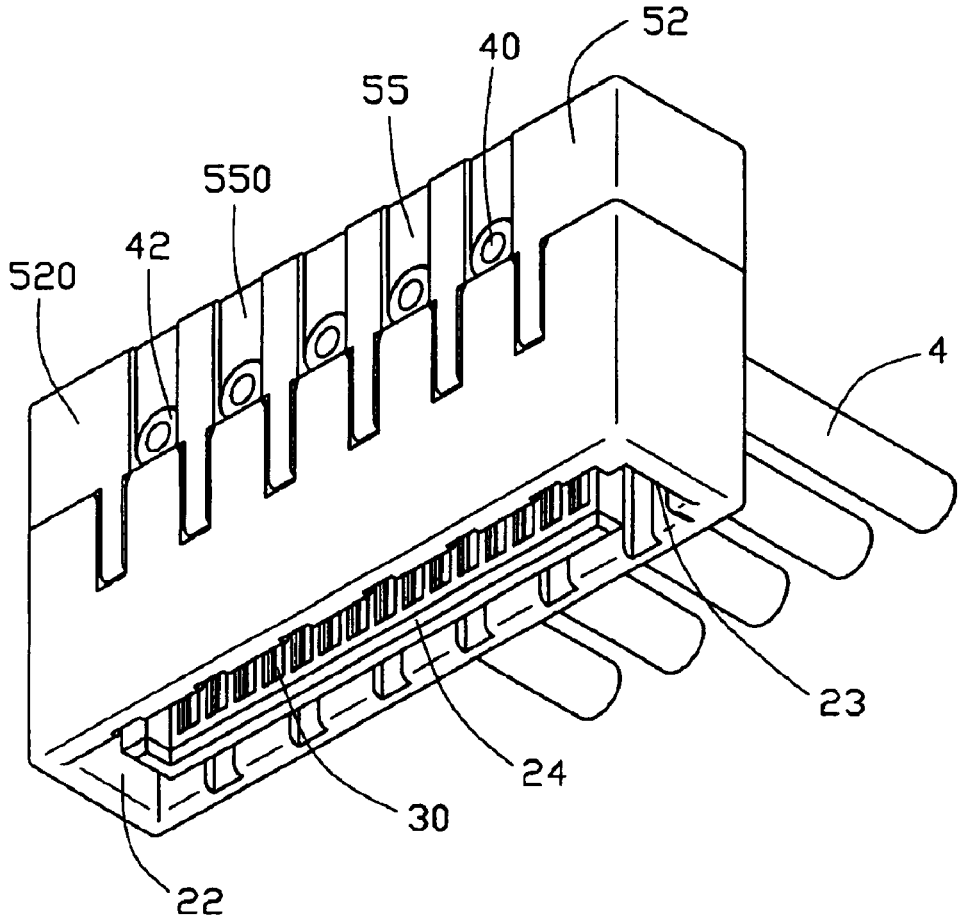
FIG. 6 is an assembled view of FIG. 2.
Figure 7:
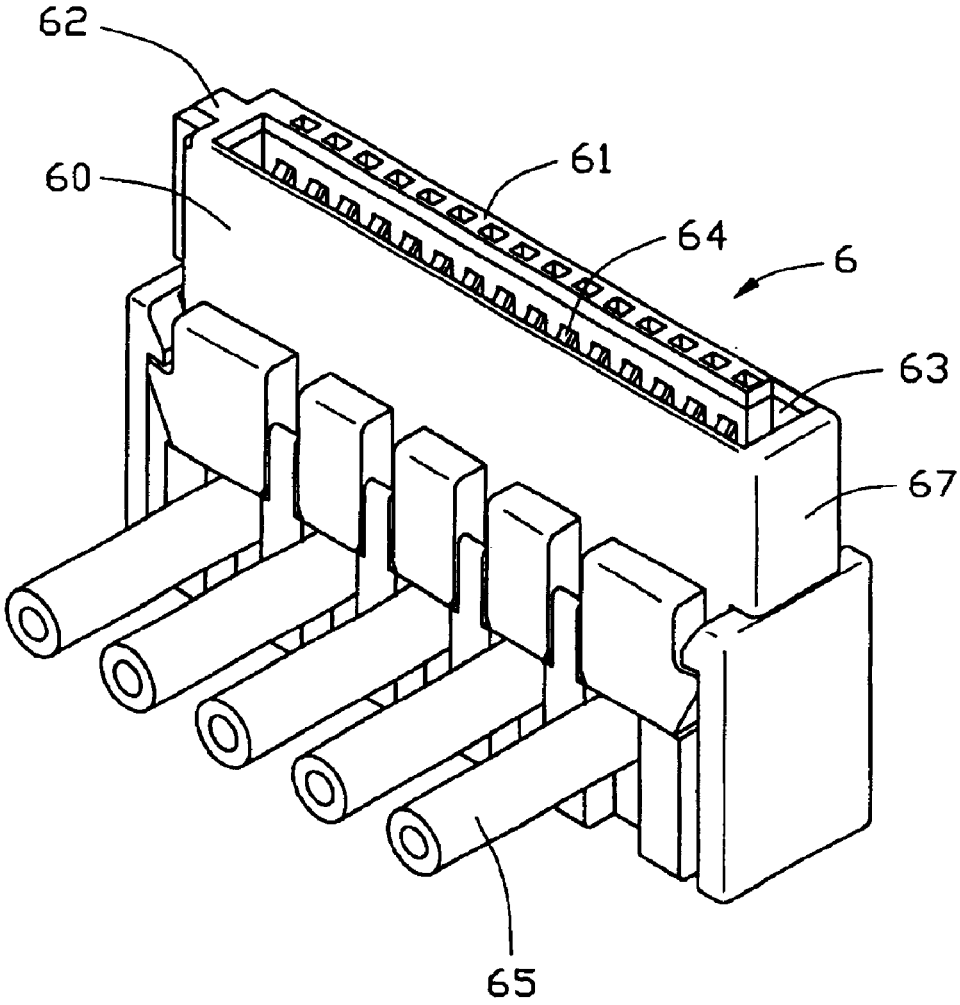
FIG. 7 is a perspective view of a complementary Serial ATA power cable receptacle connector to be mated with the safety Serial ATA IDC power cable plug connector of the present invention.
Figure 9:
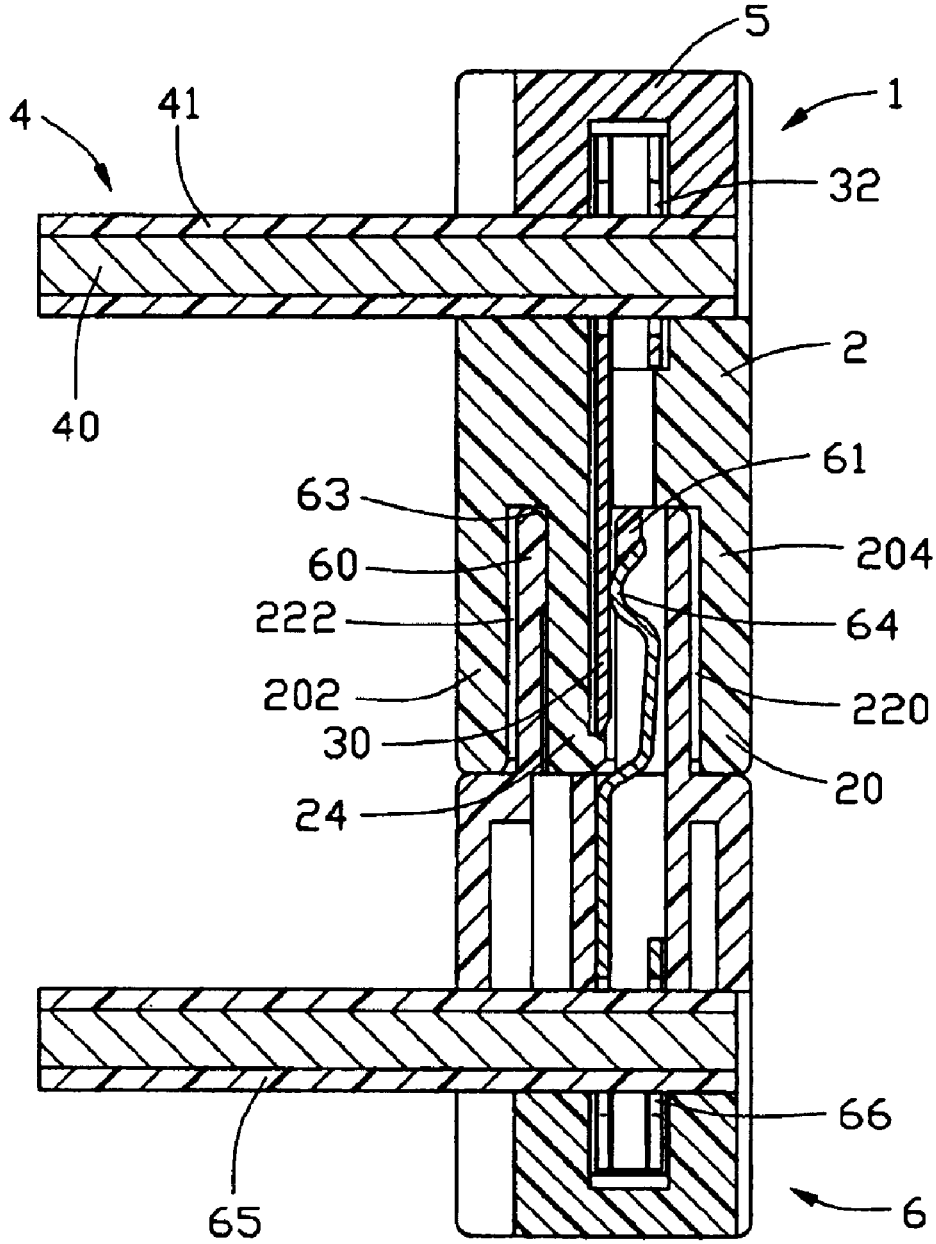
FIG. 9 is a cross-sectional view taken along line 9–9 of FIG. 8.

In assembly, also referring to FIGS. 4–6, the contacts 3 are inserted into the insulative housing 2 in a rear-to-front direction. The mating portions 30 and retention portions 31 of the contacts 3 are received in the engaging portion 20 of the insulative housing 2. The mating portions 30 are disposed on a lower side of the L-shaped tongue 24 and exposed in the receiving space 22 for electrically connecting with corresponding mating contacts 66 of a complementary Serial ATA power cable receptacle connector 6 (as shown in FIGS. 7 and 9). The first and the second walls 320, 322 of each contact 3 are received in a corresponding contact-receiving tunnel 28 with opposite sides thereof extending into the pair of opposite channels 270. The intermediate section 324 abuts against the side surface 274 of the channel 270. Thus, the insulation displacement portions 32 are reliably retained in the housing 2.

The wires 4 are respectively urged into the insulation displacement portions 32 of the contacts 3. As the wire 4 is positioned in the entry 321 of the insulation displacement portion 32, the inwardly inclined edges 328 align the wire 4 with the dual slots 326. Then the wire 4 is urged into the slots 326 with the outer insulator 41 pierced by inner edges of the slots 326, whereby the insulation displacement portion 32 connects with the conductor 40 and an electrical connection between the contact 3 and the wire 4 is established.

The insulative cover 5 is finally assembled to the insulative housing 2. Lower portions of the posts 27 are respectively received in and protrude through the cavities 572 and thus the posts 27 are exactly received in the receiving cavities 54. The latching arms 57 respectively slide along the inclined surfaces 260 of the protrusions 26 into corresponding recesses 25 and then snap onto the protrusions 26, whereby the latching arms 57 are reliably retained in the recesses 25. The wires 4 are respectively received in the wire-receiving concaves 56 and compressed by the ribs 55 to securely connect with the insulation displacement portions 32 of the contacts 3. Thus, the wires 4 are secured between the insulation displacement portions 32 and the cover 5. Especially, an end surface 42 of each wire 4 is coplanar with a side surface 550 of a corresponding rib 55 (referring to FIG. 6) which is higher than the bottom surface 520 of the bottom wall 52. Therefore, the conductors 40 of the wires 4 are protected from contacting other conductive materials and thus from influencing the power transmission between the wires 4 and the contacts 3.

FIG. 7 shows the complementary Serial ATA IDC power cable receptacle connector 6 to be mated with the safety Serial ATA IDC power cable plug connector 1 of the present invention. The detailed structure of the complementary Serial ATA IDC power cable receptacle connector 6 is disclosed in co-pending U.S. patent application Ser. No. 10/397,446, filed Mar. 25, 2003 and entitled "CABLE CONNECTOR ASSEMLBY WITH LATCHING MEANS", which has the same applicant and assignee as the present invention. The disclosure of this co-pending application is incorporated herein for reference. Therefore, a detailed description of the complementary Serial ATA IDC power cable receptacle connector 6 is eliminated in the present application. Although a Serial ATA IDC power cable receptacle connector is disclosed to mate with the safety Serial ATA IDC power cable plug connector 1 of the present invention, it should be understood that this is illustrative only, and other receptacle connectors complying with Serial ATA standards may also been applied.

Figure 8:
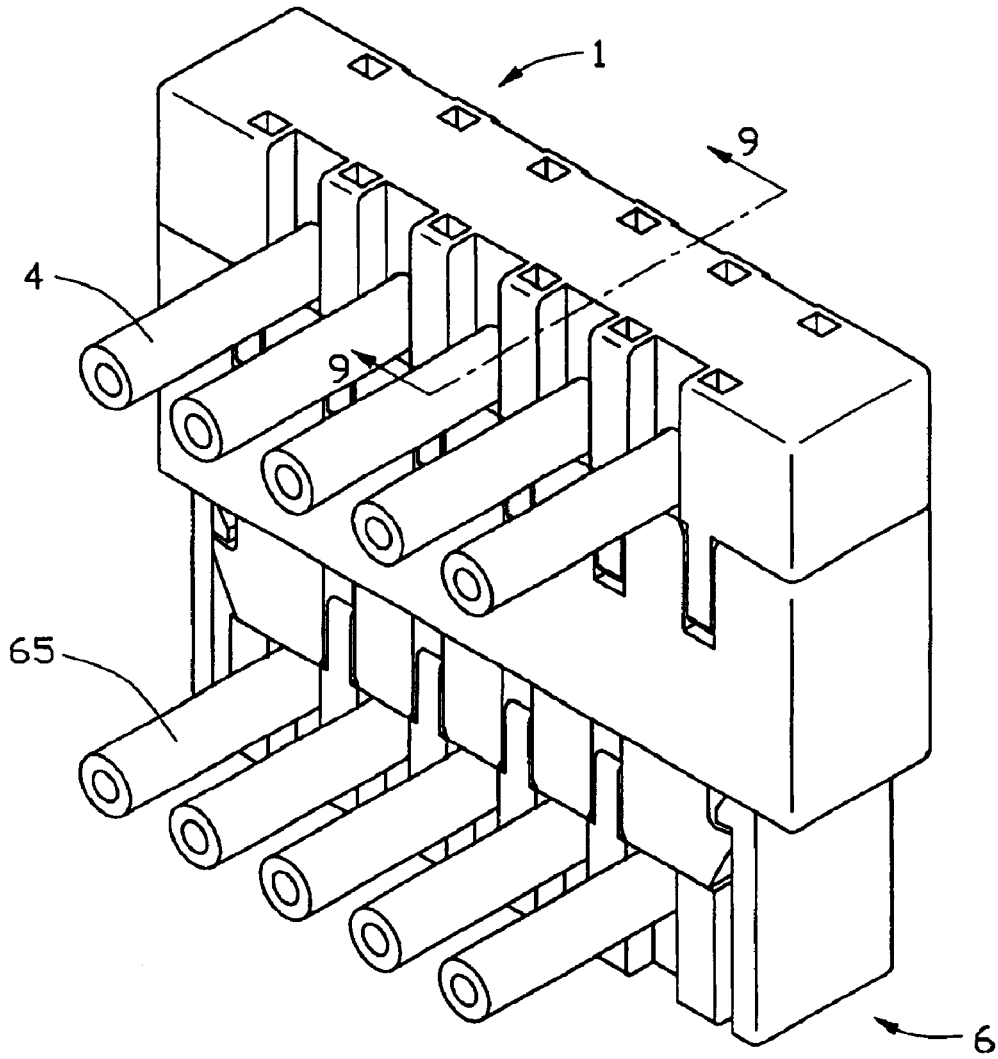
FIG. 8 is an assembled view of the complementary Serial ATA power cable receptacle connector of FIG. 7 and the safety Serial ATA IDC power cable plug connector of the present invention.

FIGS. 8 and 9 illustrate the safety Serial ATA IDC power cable plug connector 1 of the present invention mated with the complementary Serial ATA IDC power cable receptacle connector 6. The L-shaped tongue 24 of the power cable plug connector 1 is received in an L-shaped slot 63 of the complementary power cable receptacle connector 6 with the straight mating portions 30 of the contacts 3 mating with curved mating portions 64 of complementary contacts 66. The slot 23 of the power cable plug connector 1 receives a side projection 62 of the complementary power cable receptacle connector 6 for polarization purposes. The large-dimensioned part 220 and the small-dimensioned part 222 of the receiving space 22 of the power cable plug connector 1 respectively receive a thicker lower wall 61 and a thinner upper wall 60 of the complementary power cable receptacle connector 6. Thus, a front mating portion 67 of the complementary power cable receptacle connector 6 is completely received in the front engaging portion 20 of the power cable plug connector 1 with the upper wall 202, the lower wall 204 and the pair of lateral walls 206 of the power cable plug connector 1 enclosing thereabout. After assembly, wires 65 of the complementary power cable receptacle connector 6 extend in the same direction as the wires 4 of the power cable plug connector 1.

The provision of peripheral walls 202, 204 and 206 of the safety Serial ATA IDC power cable plug connector 1 of the present invention ensures that there is no danger that the hand of the user which holds the cable plug connector 1 while pulling may accidentally touch a power contact 3 thereof while the latter is still in contact with a live complementary receptacle connector. Also, the power contacts 3 are protected by the peripheral walls 202, 204 and 206 from damage. Furthermore, the safety features of the present invention would not encumber mating with the complementary receptacle connector. To ensure a correct mating with the complementary receptacle connector, the slot 23 is further defined in the power cable plug connector 1 to engage with a corresponding projection of the complementary receptacle connector.

In addition, the safety Serial ATA power cable plug connector 1 of the present invention applies IDC technology to securely attach wires 4 thereof to IDC contacts 3 thereof without stripping nor crimping the wires, so that a more reliable and simple power transmission is achieved. The dual-slot structure of the insulation displacement portion 32 of the contact 3 increases the contact areas between the contact 3 and the wire 4, so the electrical connection therebetween is more reliable. Additionally, the insulation displacement portions 32 are supported by the posts 27, so when the wires 4 are urged into the slots 326, the possibility of deformation of the insulation displacement portions 32 is decreased. The ribs 55 of the cover 5 compress the wires 4 to the insulation displacement portions 32 of the contacts 3, thereby preventing the wires 4 from separating from the contacts 3 and assuring a reliable power transmission therebetween. The plurality of latching arms 57 mounts the cover 5 to the housing 2 more reliably, and further assures the reliable power transmission between the wires 4 and the contacts 3.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A cable plug connector comprising:

an insulative housing comprising a front engaging portion and an opposite rear terminating portion, the engaging portion having a receiving space defined by a first side wall and a pair of lateral walls thereof, adapted for receiving a complementary receptacle connector, and a tongue projecting into the receiving space;

a plurality of contacts retained in the insulative housing, each contact having a mating portion disposed on one side of the tongue facing the first side wall, and an opposite insulation displacement portion received in the terminating portion;

a plurality of cable wires having individual ends terminated to the insulation displacement portions of the contacts; and a cover mounted to the insulative housing, the cover compressing said ends of the cable wires into reliable electrical connection with the insulation displacement portions of the contacts wherein the tongue of the insulative housing is L-shaped;

wherein the engaging portion of the insulative housing defines a slot at an end thereof in communication with the receiving space;

wherein the cable wires extend in a direction perpendicular to that of the contacts;

wherein the engaging portion of the insulative housing further comprises a second side wall opposite to the first side wall, the first and second side walls having a plurality of recesses defined in respective outer sides thereof and a corresponding number of protrusions formed on bottoms of respective recesses;

wherein the cover comprises a first wall, an opposite second wall, a pair of sidewalls, and a plurality of pairs of latching arms extending from the respective first and second walls, the latching arms being received in corresponding recesses and latching onto corresponding protrusions of the insulative housing;

wherein the first and second walls of the cover each are partly cutoff to form a plurality of ribs and a plurality of semicircular wire-receiving concaves for receiving said ends of the wires therein, and wherein the wires are compressed toward the contacts by the ribs;

wherein said ends of the wires each comprise an end surface coplanar with an outer side surface of each rib of one of the first and second walls of the cover;

wherein the terminating portion of the insulative housing comprises a plurality of posts, every two neighboring posts defining a contact-receiving tunnel therebetween for receiving the insulation displacement portions of the contacts therein, and wherein the cover defines a plurality of receiving cavities receiving the posts of the terminating portion of the insulative housing therein;

wherein the insulation displacement portion of each contact includes a first wall, a second wall opposite to the first wall, and an intermediate section connecting the first and second walls, the first and the second walls each defining a slot, the slots of each contact aligning with each other for receiving said one end of a corresponding cable wire.

2. A cable connector assembly comprising:

a cable plug connector comprising an insulative body having a first side wall and a pair of opposite lateral walls cooperatively defining a receiving space, and a tongue projecting into the receiving space; a plurality of contacts retained in the insulative body, each contact having a mating portion disposed on the tongue facing the first side wall, and a tail portion opposite to the mating portion; and a plurality of cable wires having individual ends terminated to the tail portions of the contacts; and a complementary receptacle connector having a mating portion, the mating portion comprising a dielectric body and a plurality of mating contacts received in the dielectric body, the dielectric body having a slot and a side wall receiving the mating contacts therein, the mating contacts having curved mating portions projecting into the slot;

wherein, when mating the complementary receptacle connector with the cable plug connector, the slot of the receptacle connector receives the tongue of the cable plug connector, and the side wall of the receptacle connector is received in a portion of the receiving space defined between the tongue and the first side wall of the cable plug connector, whereby the mating portions of the mating contacts of the receptacle connector are brought into electrical connection with corresponding mating portions of the contacts of the cable plug connector;

wherein the insulative body of the cable plug connector further comprises a second side wall opposite to the first side wall, and the first side wall, the second side wall and the pair of lateral walls cooperatively enclose the mating portion of the complementary receptacle connector after engagement between the cable plug connector and the complementary receptacle connector;

wherein the insulative body of the cable plug connector defines a plurality of recesses in the side wall with protrusions therein, and the cable plug connector further includes a cover defining a side face with a plurality of latching arms respectively extending therefrom into the corresponding recesses and latched with the corresponding protrusions, the whole side wall extending in a coplanar manner except portions in the recesses, and the side face and the side wall being generally coplanar with each other after the insulative body and the first cover are assembled together;

wherein the side wall of the dielectric body of the complementary receptacle connector extends in a non-coplanar maner to form the small dimensioned mating portion for receipt in the receiving space, while the side wall of the cable plug connector including the side face of the cover thereof and the side wall of the complementary receptacle connector are coplanar with eac other when said cable plug connector and said complementary receptacle connector are mated with each other.

* * * * *